US010163291B2

(12) United States Patent
Numata et al.

(10) Patent No.: US 10,163,291 B2
(45) Date of Patent: Dec. 25, 2018

(54) MONEY HANDLING SYSTEM AND MONEY HANDLING METHOD

(71) Applicant: GLORY LTD., Himeji-shi, Hyogo (JP)

(72) Inventors: Toshio Numata, Himeji (JP); Tetsuya Tameike, Himeji (JP)

(73) Assignee: GLORY LTD., Himeji-shi (JP)

( * ) Notice: Subject to any disclaimer, the term of this patent is extended or adjusted under 35 U.S.C. 154(b) by 0 days.

(21) Appl. No.: 15/527,401

(22) PCT Filed: Nov. 25, 2015

(86) PCT No.: PCT/JP2015/083106

§ 371 (c)(1),
(2) Date: May 17, 2017

(87) PCT Pub. No.: WO2016/084856

PCT Pub. Date: Jun. 2, 2016

(65) Prior Publication Data

US 2017/0358164 A1 Dec. 14, 2017

(30) Foreign Application Priority Data

Nov. 27, 2014 (JP) ..... 2014-239553

(51) Int. Cl.

| | |
|---|---|
| ***G06M 3/00*** | (2006.01) |
| ***G07D 11/00*** | (2006.01) |
| ***G07D 7/00*** | (2016.01) |

(Continued)

(52) U.S. Cl.

CPC ..... *G07D 11/0084* (2013.01); *G07D 3/00* (2013.01); *G07D 7/00* (2013.01); *G07D 9/00* (2013.01);

(Continued)

(58) Field of Classification Search

CPC ..... G07D 7/00; G07D 7/003; G07D 11/00; G07D 11/0021; G07D 11/0051;

(Continued)

(56) References Cited

U.S. PATENT DOCUMENTS

| | | | |
|---|---|---|---|
| 8,478,020 | B1 | 7/2013 | Jones et al. |
| 2010/0032352 | A1 | 2/2010 | Ozaki et al. |

(Continued)

FOREIGN PATENT DOCUMENTS

| | | | |
|---|---|---|---|
| JP | 2002-334362 | A | 11/2002 |
| JP | 2009-282560 | A | 12/2009 |
| JP | 4586135 | B2 | 11/2010 |
| JP | 2013-114398 | A | 6/2013 |

(Continued)

OTHER PUBLICATIONS

European Search Report, Application No. 15862736.4, dated Sep. 7, 2018, 8 pages.

*Primary Examiner* — Mark J Beauchaine
(74) *Attorney, Agent, or Firm* — Foley & Lardner LLP

(57) ABSTRACT

A money handling system allows easy handling of money, which is processed in a first money handling apparatus installed in a shop and the like, in a second money handling apparatus installed in another place. The money is transported using a container in which the money is stored in mixed state. The second money handling apparatus receives, recognizes and counts the money of a plurality of transactions processed by the first money handling apparatus. Based on money information generated when processed by the first money handling apparatus and a recognition and counting result obtained by the second money handling apparatus, it is determined whether the money recognized and counted by the second money handling apparatus matches with the money from the plurality of transactions processed by the first money handling apparatus.

18 Claims, 6 Drawing Sheets

(51) Int. Cl.
*G07D 3/00* (2006.01)
*G07D 9/00* (2006.01)
*G07F 19/00* (2006.01)

(52) U.S. Cl.
CPC ..... *G07D 11/0054* (2013.01); *G07D 11/0066* (2013.01); *G07D 11/0069* (2013.01); *G07D 11/0075* (2013.01); *G07F 19/202* (2013.01); *G07F 19/203* (2013.01); *G07F 19/209* (2013.01)

(58) Field of Classification Search
CPC .. G07D 11/0069; G07D 11/0072; G07F 7/04; G07F 19/00; G07F 19/20; G07F 19/202
See application file for complete search history.

(56) References Cited

U.S. PATENT DOCUMENTS

| | | | | |
|---|---|---|---|---|
| 2012/0041590 | A1 | 2/2012 | Ozaki et al. | |
| 2012/0273323 | A1 | 11/2012 | Tameike | |
| 2014/0039673 | A1 | 2/2014 | Sakamoto et al. | |
| 2014/0040085 | A1* | 2/2014 | Angus | G07D 11/0006 705/35 |
| 2014/0166432 | A1 | 6/2014 | Saiki | |
| 2015/0170454 | A1* | 6/2015 | Sasaki | G07D 11/0066 382/135 |
| 2017/0098134 | A1* | 4/2017 | Jones | G06K 9/20 |

FOREIGN PATENT DOCUMENTS

| | | | |
|---|---|---|---|
| WO | WO 2013/176173 | A1 | 11/2013 |
| WO | WO 2014/109119 | A1 | 7/2014 |

* cited by examiner

FIG.4

| SHOP NUMBER | TRANSACTION NUMBER | DENOMINATION | SERIAL NUMBER |
|---|---|---|---|
| A001 | 20141110-C01 | 100 | AB··· ⋮ |
| | | 50 | XY··· ⋮ |
| | | ⋮ | |
| | 20141110-C02 | 100 | CD··· ⋮ |
| | | ⋮ | |
| | 20141110-C03 | 100 | EF··· ⋮ |
| | | ⋮ | |

MONEY HANDLING SYSTEM AND MONEY HANDLING METHOD

TECHNICAL FIELD

The present invention relates to a money handling system and a money handling method for handling money collected in an office of a financial institution, a shop of a commercial facility, and the like.

BACKGROUND ART

Conventionally, cash collected from a branch of a bank, a shop of a retail store, and the like, is transported to a predetermined base called a cash collection center. The collected cash is managed in the cash collection center. For example, in a retail store, to transport the proceeds of sales of a day to the cash collection center after the business hours, a deposit process to recognize and count banknotes collected from a plurality of cash registers (hereinafter, "cash-register") is performed in a banknote handling apparatus installed in a back office. In this deposit process, partitioning cards called header cards are used to separate the deposited banknotes from each cash-register. The banknotes collected from the plurality of cash-registers are collectively transported to the cash collection center as one bundle while being separated per cash-register by using the header cards. In the cash collection center, the bundle of the banknotes separated by the header cards is set on a money inlet and deposited in the banknote handling apparatus.

Patent Document 1 discloses a paper sheet handling apparatus for handling banknotes in succession while distinguishing the banknotes per transaction by using header cards on which a barcode has been printed. In a shop which is an origin of the transport of the banknotes, a deposit process of banknotes collected from one cash-register is considered as one transaction. Every time a deposit process of one transaction is finished, one header card is attached to the banknotes of the transaction. In the cash collection center, which is a destination of the banknotes that are separated by the header cards and transported from the shop, the banknotes are handled using the apparatus disclosed in Patent Document 1. The banknotes of the plurality of transactions are handled in succession while distinguishing the banknotes per transaction based on the header cards attached thereto. In the apparatus disclosed in the Patent Document 1, information relating to the transaction can be printed on the header card. The banknotes handled in succession can be distinguished per transaction based on the header card attached thereto, and data relating to the recognition and counting of the banknotes can be managed based on the printed information acquired from the header card.

CITATION LIST

Patent Document

[Patent Document 1] Japanese Patent Application Laid-Open No. 2002-334362

SUMMARY OF INVENTION

Technical Problem

However, in the known technology, it is necessary to perform a time consuming operation of preparing a header card for each transaction and inserting the prepared header card on the top of the banknotes of each transaction. Moreover, after processing of the banknotes separated by the header cards, it is necessary to perform an operation to collect the header cards that have now become unnecessary.

Moreover, to distinguish the banknotes per transaction with the header cards at the transport destination, it is necessary to manage the banknotes, which have been separated per transaction by attaching the header card at the transport origin, so that the banknotes of different transactions do not mix until the process at the transport destination is completed. Therefore, it can be necessary to perform a complicated operation including putting the banknotes of one transaction and the corresponding header card together in one envelope so that the banknotes of different transactions are not mixed.

The present invention is made to address the problems in the conventional technology. An object of the present invention is to provide a money handling system and a money handling method that allow easy handling of money collected in an office of a financial institution, a shop of a commercial facility, and the like, and transported to a cash collection center and the like.

Means for Solving Problems

To solve the above problem, and to achieve the above object, according to a first aspect of the present invention, there is provided a money handling system comprising a second money handling apparatus that receives, recognizes and counts money of a plurality of transactions processed by a first money handling apparatus, the money being in a state where money of each transaction is not separated; and a determination unit that acquires money information generated when the money of the plurality of transactions has been processed by the first money handling apparatus, and based on the money information and a recognition and counting result obtained by recognizing and counting the money by the second money handling apparatus, determines whether the money of the plurality of transactions recognized and counted by the second money handling apparatus matches with the money of the plurality of transactions processed by the first money handling apparatus.

In the above money handling system, the determination unit may perform a determination by performing a total comparison process in which a total amount of the money of the plurality of transactions obtained based on the money information and a total amount of the money obtained by recognizing and counting the money by the second money handling apparatus are compared.

In the above money handling system, the determination unit may perform a determination by performing another total comparison process in which a total number of the money of the plurality of transactions obtained based on the money information and a total number of the money obtained by recognizing and counting the money by the second money handling apparatus are compared.

In the above money handling system, the money information may include identification numbers of the money of each transaction processed in the first money handling apparatus, the identification numbers being separated per transaction. The second money handling apparatus acquires an identification number of each of the money processed in the first money handling apparatus. The determination unit performs a determination by performing an identification number comparison process in which the identification number of each of the money acquired by the second money handling apparatus and the identification numbers included in the money information are compared.

In the above money handling system, the money information may include identification numbers of the money of each transaction processed in the first money handling apparatus, the identification numbers being separated per transaction. When a result of the total comparison process indicates that both of totals do not match with each other, the determination unit performs an identification number comparison process in which the identification number of each of the money acquired by the second money handling apparatus and the identification numbers included in the money information are compared.

In the above money handling system, the determination unit may identify an identification number that does not match between the identification numbers included in the money information and the identification numbers acquired by the second money handling apparatus, and identifies a transaction to which the money having the identified identification number belongs.

In the above money handling system, the determination unit identifies an identification number that does not match between the identification numbers included in the money information and the identification numbers acquired by the second money handling apparatus, and notifies information about the money having the identified identification number.

According to another aspect of the present invention, there is provided a money handling system comprising a money handling unit that recognizes and counts money of a plurality of transactions without distinguishing money of each transaction; and a determination unit that acquires money information about the money of the plurality of transactions generated previously per transaction, and based on the money information and a recognition and counting result obtained by recognizing and counting the money by the money handling unit, determines whether the money of the plurality of transactions processed in the money handling unit and the money corresponding to the money information match with each other.

In the above money handling system, the determination unit may perform a determination by performing a total comparison process in which a total amount of the money of the plurality of transactions obtained based on the money information and a total amount of the money obtained by recognizing and counting by the money handling unit are compared.

In the above money handling system, the money information may include identification numbers of the money of each transaction processed in the money handling unit, the identification numbers being separated per transaction, and only when a result of the total comparison process indicates that both of totals do not match with each other, the determination unit performs an identification number comparison process in which the identification number of each of the money acquired by the money handling unit and the identification numbers included by the money information are compared.

According to still another aspect of the present invention, there is provided a money handling method implemented by a money handling system comprising the steps of recognizing and counting by a second money handling apparatus money of a plurality of transactions processed by a first money handling apparatus, the money received by the second money handling apparatus being in a state where money of each transaction is mixed; acquiring money information generated when the money of the plurality of transactions has been processed by the first money handling apparatus; and determining whether the money of the plurality of transactions recognized and counted by the second money handling apparatus matches with the money of the plurality of transactions processed by the first money handling apparatus, based on the money information and a recognition and counting result of the money obtained at the recognizing and counting.

According to still another aspect of the present invention, there is provided a money handling method implemented by a money handling system comprising the steps of recognizing and counting by a first money handling apparatus money of a plurality of transactions per transaction; generating money information including a recognition and counting result obtained at the recognizing and counting, the recognition and counting result being separated per transaction; putting money of each transaction processed at the recognizing and counting in a money container in a mixed state and transporting the money container from an installation site of the first money handling apparatus to an installation site of a second money handling apparatus; recognizing and counting by the second money handling apparatus the money taken out of the money container and put into the second money handling apparatus, the money being in a state where the money of each transaction is mixed; acquiring the money information generated at the generating; and determining whether the money taken out of the money container matches with the money of the plurality of transactions processed by the first money handling apparatus, based on the money information acquired at the acquiring and a recognition and counting result of the money obtained at the recognizing and counting by the second money handling apparatus.

Advantageous Effects of Invention

According to the present invention, for example, in the shop that is a transport origin of the banknotes, the denominations and the serial numbers of the banknotes processed in the deposit process by using the first banknote handling apparatus are managed per deposit process (per transaction) as the banknote information. In the cash collection center that is a transport destination of the banknotes, the second banknote handling apparatus recognizes and counts the banknotes transported thereto from the shop. Depending on whether the obtained result of recognition and counting matches with the banknote information generated in the transport origin, it can be determined whether it can be deemed that the transported banknotes are the banknotes processed in the first banknote handling apparatus. For example, if a total amount of the banknotes processed in the deposit process in the shop matches with a total amount of the banknotes transported to the cash collection center, it can be deemed that the banknotes transported to the cash collection center match with the banknotes processed in the deposit process in the shop. If a total number of the banknotes processed in the deposit process in the shop matches with a total number of the banknotes transported to the cash collection center, it can be deemed that the banknotes transported to the cash collection center match with the banknotes processed in the deposit process in the shop.

According to the present invention, only when a total amount (or a total number) of the banknotes calculated from the banknote information does not match with a total amount (or a total number) of the banknotes obtained by recognizing and counting in the second banknote handling apparatus, the comparison process, in which the serial number of each of the banknotes acquired in the first banknote handling apparatus and the serial number of each of the banknotes acquired in the second banknote handling apparatus are compared, is performed to investigate a reason why the totals do not match with each other. Accordingly, the load of the process can be reduced as compared to the situation in which the serial number comparison process is performed at all the time.

According to the present invention, the serial numbers of the banknotes are managed per transaction, and the serial numbers included in the banknote information generated in the shop and the serial numbers acquired in the cash collection center are compared. Accordingly, a serial number that is not contained in any of the serial numbers included the banknote information and the serial numbers acquired in the cash collection center can be identified and notified. Therefore, banknotes lost and/or mixed after the deposit process can be identified and the particulars of the handling of these banknotes can be investigated.

BRIEF DESCRIPTION OF DRAWINGS

FIG. 4 indicates an example of banknote information managed in a first terminal.

DETAILED DESCRIPTION

Exemplary embodiments of a money handling system and a money handling method according to the present invention will now be explained with reference to the accompanying drawings. The money handling performed by the money handling system and method according to the present invention includes counting, collecting, transporting, and sorting a large amount of money including banknotes and coins in a shop of a retail store, a financial institution, a transport facility, and the like. In the following explanation, a case in which banknotes are collected from a plurality of cash registers (hereinafter, "cash-register") installed in a shop of a retail store and transported to a cash collection center is explained as an example.

Figure 1:
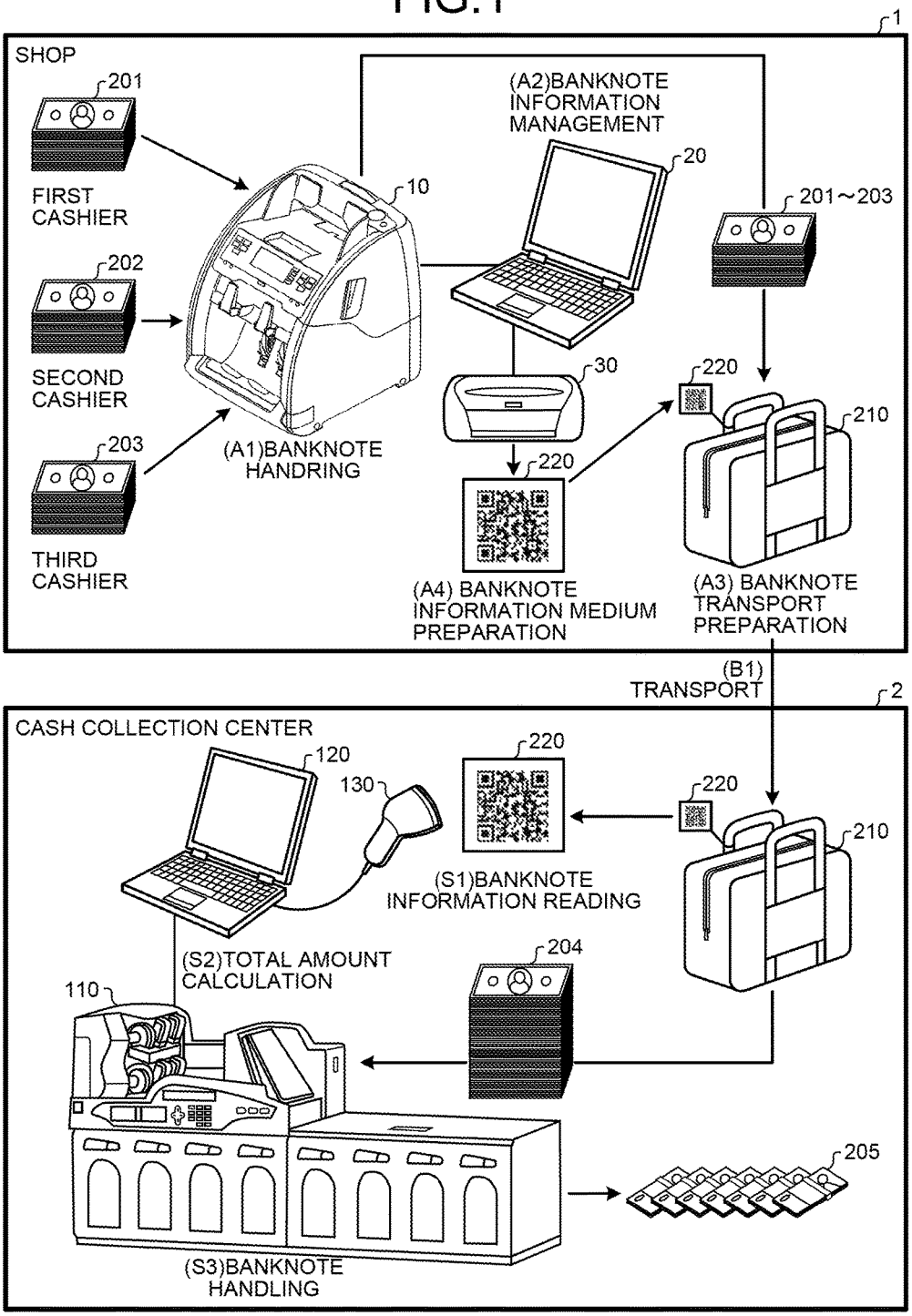
FIG. 1 is a schematic diagram indicating an outline of a configuration of and a process performed by a banknote handling system according to the present embodiment.

A configuration of a banknote handling system is explained below with reference to FIGS. 1 to 3. FIG. 1 is a schematic diagram indicating a configuration of the banknote handling system and handling process performed by the banknote handling system according to an embodiment. The banknote handling system includes a first banknote handling system built in a shop 1 and a second banknote handling system built in a cash collection center 2. The first banknote handling system built in the shop 1 includes a first banknote handling apparatus 10, a first terminal 20, and a barcode printer 30. The second banknote handling system built in the cash collection center 2 includes a second banknote handling apparatus 110 (money handling unit), a second terminal 120 (determination unit), and a barcode reader 130.

Figure 2:
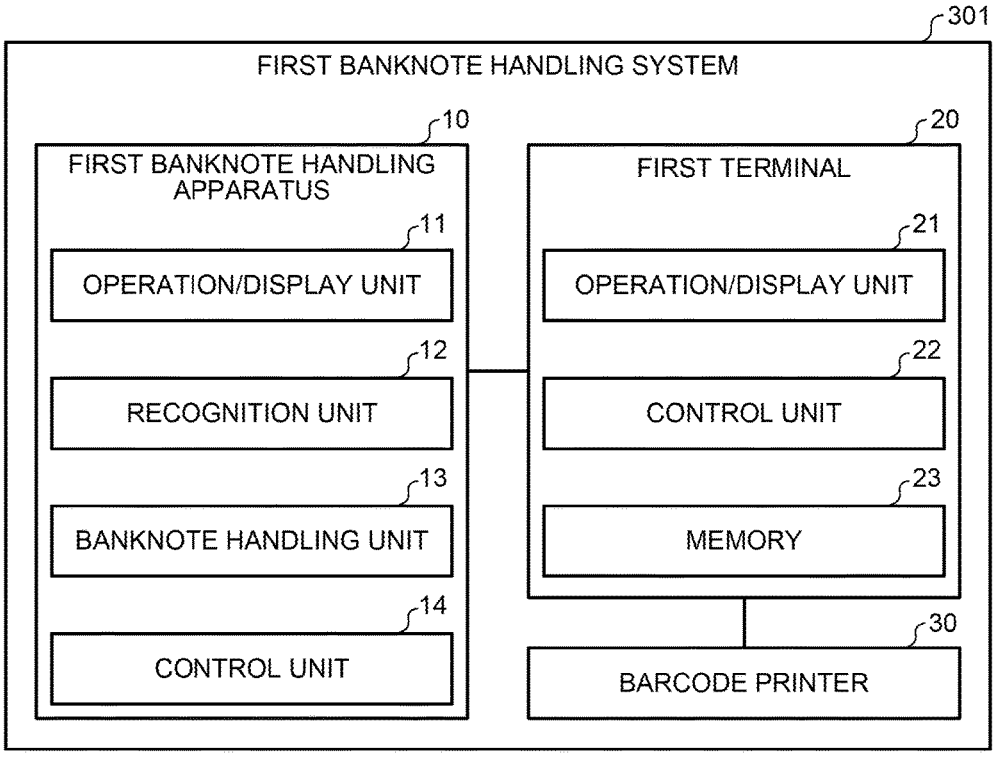
FIG. 2 is a block diagram of a configuration example of a first banknote handling system installed in a shop.

FIG. 2 is a block diagram of a configuration example of a first banknote handling system 301 installed in the shop 1. The first banknote handling apparatus 10 includes an operation/display unit 11, a recognition unit 12, a banknote handling unit 13, and a control unit 14.

The operation/display unit 11 has a function to perform input of information necessary to perform various processes and/or settings, and to perform output and display of various pieces of information. The recognition unit 12 has a function to recognize a denomination, authenticity, fitness, and the like of a banknote. The banknote handling unit 13 has a function to feed into inside of the apparatus a large number of banknotes, one by one, placed on a hopper and transport the fed banknote via a transport path arranged inside the apparatus to the recognition unit 12. Normal banknotes whose denomination and the like could be recognized by the recognition unit 12 are discharged and stacked in a stacker. Banknotes that cannot be recognized by the recognition unit 12, banknotes recognized as counterfeit banknotes by the recognition unit 12, and the like are discharged in a reject unit as reject banknotes. A detailed explanation of the banknote handling performed in the first banknote handling apparatus 10, whose external appearance is as shown in FIG. 1, having one hopper, one stacker, and one reject unit is known in the art and will be omitted.

The control unit 14 has a function to control input and output of information by using the operation/display unit 11, and to control the recognition unit 12 and the banknote handling unit 13. Moreover, the control unit 14 has a function to output to the first terminal 20 a result of recognition and counting, serial numbers, information relating to the process of the banknotes, and the like obtained in the first banknote handling apparatus 10 by performing the banknote handling. The serial number is a money number (identification number) printed on a banknote to identify the banknote. Each banknote can be distinguished by the serial number printed thereon.

The first terminal 20 connected to the first banknote handling apparatus 10 is, in this example, a computer device. The first terminal 20 includes an operation/display unit 21, a control unit 22, and a memory 23. In the first terminal 20, the control unit 22 stores in the memory 23 information such as the results of recognition and counting and the serial numbers of the banknotes input from the first banknote handling apparatus 10. The control unit 22 manages a plurality of pieces of information per transaction.

The barcode printer 30 connected to the first terminal 20 has a function to print a two-dimensional barcode 220. When transporting the banknotes from the shop 1 to the cash collection center 2, the two-dimensional barcode 220, including information such as denominations and serial numbers of all the banknotes to be transported, is printed by the barcode printer 30.

Figure 3:
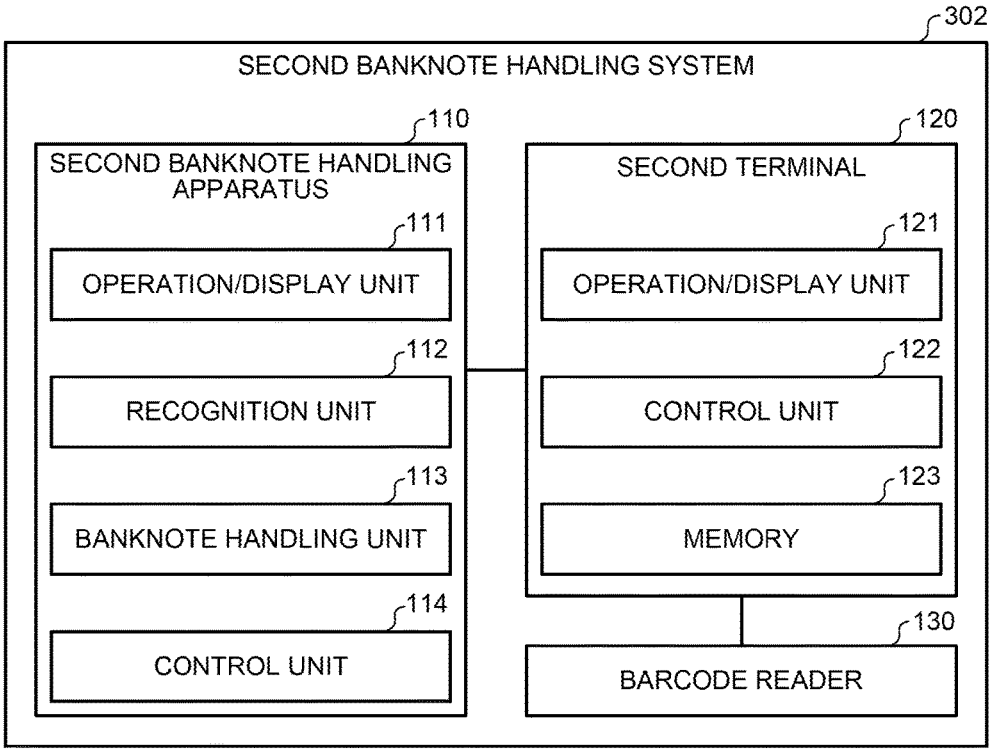
FIG. 3 is a block diagram of a configuration example of a second banknote handling system installed in a cash collection center.

FIG. 3 is a block diagram of a configuration example of a second banknote handling system 302 installed in the cash collection center 2. The second banknote handling apparatus 110 includes an operation/display unit 111, a recognition unit 112, a banknote handling unit 113, and a control unit 114.

The operation/display unit 111 has a function to perform input of information necessary to perform various processes and/or settings, and to perform output and display of various pieces of information. The recognition unit 112 has a function to recognize a denomination, authenticity, fitness, and the like of a banknote. The banknote handling unit 113 has a function to feed into inside of the apparatus a large number of banknotes, one by one, placed on a hopper and transport the fed banknote via a transport path arranged inside the apparatus to the recognition unit 112. Normal banknotes whose denomination and the like could be recognized by the recognition unit 112 are sorted and stacked in a corresponding stacker. Banknotes that cannot be recognized by the recognition unit 112, banknotes recognized as counterfeit banknotes, and the like are discharged in a reject unit as rejected banknotes. A detailed explanation of the banknote handling performed in the second banknote handling apparatus 110, whose external appearance is as shown in FIG. 1, having one hopper, one reject unit, and a plurality of stackers is known in the art and will be omitted.

The control unit 114 has a function to control input and output of information by using the operation/display unit 111, and to control the recognition unit 112 and the banknote handling unit 113. Moreover, the control unit 114 has a function to output to the second terminal 120 a result of recognition and counting, serial numbers, information relating to the process of the banknotes, and the like obtained in the second banknote handling apparatus 110 by performing the banknote handling.

The second terminal 120 connected to the second banknote handling apparatus 110 is constituted by, in this example, a computer device. The second terminal 120 includes an operation/display unit 121, a control unit 122, and a memory 123. In the second terminal 120, the control unit 122 stores in the memory 123 information such as the results of recognition and counting and the serial numbers of the banknotes input from the second banknote handling apparatus 110. The control unit 122 manages a plurality of pieces of information.

In the second terminal 120, the control unit 122 has a function to check whether all the banknotes processed by the first banknote handling apparatus 10 installed in the shop 1 for a deposit process were transported to the cash collection center 2. A checking method can be set in the second terminal 120. In an example, it is possible to check whether a total number of banknotes processed in the deposit process in the shop 1 and a total number of banknotes transported to the cash collection center 2 match with each other, and determine that all the banknotes were transported from the shop 1 to the cash collection center 2 when both the numbers match with each other. In another example, it is possible to check whether a total amount of banknotes processed in the deposit process in the shop 1 and a total amount of banknotes transported to the cash collection center 2 match with each other, and to determine that all the banknotes were transported from the shop 1 to the cash collection center 2 when both the amounts match with each other. In a further example, it is possible to check whether serial numbers of banknotes processed in the deposit process in the shop 1 and serial numbers of banknotes transported to the cash collection center 2 match with each other, and to determine that all the banknotes were transported from the shop 1 to the cash collection center 2 when all the serial numbers read in the shop 1 match with the serial numbers read in the cash collection center 2. The determination process will be explained later.

The barcode reader 130 connected to the second terminal 120 has a function to read the two-dimensional barcode 220 printed by the barcode printer 30 of the shop 1. After the banknotes are transported from the shop 1 to the cash collection center 2, the two-dimensional barcode 220 including the information such as the denominations and the serial numbers of all the transported banknotes is read by the barcode reader 130. The information such as the denominations and the serial numbers of the banknotes can be acquired from the read barcode.

The banknote handling performed in the shop 1 will be explained next with reference to FIG. 1. In the below explanation, as shown in FIG. 1, it is assumed that three cash-registers, operated by first to third cashiers, respectively, are installed in the shop 1.

For example, in the shop 1, when a cashier of a cash-register is to be switched, the cashier uses the first banknote handling apparatus 10 to perform a deposit process (banknote handling) including recognizing and counting the banknotes collected from the cash-register assigned to the cashier (A1). In this deposit process, an ID (identification information) for recognizing each of the first to third cashiers is input by operating the operation/display unit 11 of the first banknote handling apparatus 10 or the operation/display unit 21 of the first terminal 20.

The first banknote handling apparatus 10 may have a configuration in which the banknotes are discharged in an open-type stacker instead of storing the recognized and counted banknotes in a storing unit arranged inside the apparatus, but still this process will be referred to as the deposit process in the present specification. In this configuration, a recognition and counting process will be carried out as a deposit process to deposit a banknote. The banknotes that have been processed in the deposit process are stored in the shop 1 as proceeds of sales. Subsequently, at a predetermined timing, such as after the business hours, the banknotes are transported from the shop 1 to the cash collection center 2. A method for inputting the IDs of the first to third cashiers is not limited to manually input by using the operation/display units 11 and 21. For example, a card reader (not-shown) can be connected to the first terminal 20, and the cashier ID can be input by reading with the card reader an employee card and the like including the identification information such as the cashier ID.

The first cashier operates the operation/display unit 11 of the first banknote handling apparatus 10 to start handling of a banknote bundle 201 collected from the cash-register assigned to the first cashier. Inside the first banknote handling apparatus 10, the denomination and the like of each of the banknotes contained in the banknote bundle 201 are recognized by the recognition unit 12. Moreover, the serial number of each of the banknotes is acquired by performing a character recognition process by using an image of the banknote captured in the recognition unit 12. The denomination and the serial number of each of the banknotes acquired by the first banknote handling apparatus 10 are input into the first terminal 20 by the control unit 14. In the present embodiment, a banknote bundle refers to a plurality of banknotes. For example, the banknote bundle 201 refers to a plurality of banknotes 201 collected from the cash-register.

The banknotes as the target of the deposit process may contain a banknote whose denomination and/or authenticity cannot be recognized. When such a banknote is present, in the first banknote handling apparatus 10, information such as the denomination of this banknote can be input by operating the operation/display unit 11. The information about the banknote input manually is input by the recognition unit 12 into the first terminal 20 along with the result of recognition and counting of other banknotes. However, the result of recognition and counting obtained by the recognition unit 12 and the result of recognition and counting input manually by operating the operation/display unit 11 are managed separately.

In the first terminal 20, the control unit 22 manages in an associated manner, as banknote information (money information), the ID of the cashier, an identification number for distinguishing each of the transactions performed in the first banknote handling apparatus 10, the denominations, the serial numbers, and the like of the banknotes contained in the banknote bundle 201. The banknote information is stored in the memory 23 of the first terminal 20 and managed (A2 of FIG. 1). The banknote bundle 201, the banknotes contained in which are recognized and counted and the serial numbers thereof are acquired in the first banknote handling apparatus 10, is put in a banknote container 210, such as a box or a bag, for transporting the banknotes from the shop 1 to the cash collection center 2 (A3).

Similarly, when the second cashier performs by using the first banknote handling apparatus 10 a deposit process to deposit a banknote bundle 202 collected from the cash-register the second cashier has been operating, information such as the denomination and the serial number of each of the banknotes contained in this banknote bundle 202 is acquired. The information is managed in the first terminal 20 as the banknote information. Moreover, when the third cashier performs by using the first banknote handling apparatus 10 a deposit process to deposit a banknote bundle 203 collected from the cash-register the third cashier has been operating, information such as the denomination and the serial number of each of the banknotes contained in this banknote bundle 203 is acquired. The information is managed as the banknote information in the first terminal 20. The banknote bundles 201~203 of which the deposit process is finished in the shop 1 are put in the same banknote container 210. When doing so, however, it is not necessary to separately put the banknote bundles 201~203 in the banknote container 210. For example, the banknotes contained in each of the banknote bundles 201~203 can be put in a mixed state in the banknote container 210. Therefore, the banknote container 210 does not have to be a container dedicated for banknote. The banknote container 210 does not have to have a structure that prevents mixing of the banknotes stored therein. For example, a pouch or a bag made of cloth can be used as the banknote container 210. The mixed state of the banknotes is referred to as a state in which banknotes cannot be distinguished per transaction. It includes a state in which banknotes (banknote bundles 201~203) of a plurality of transactions are dumped in the bag in a loose state, a state in which banknotes are stacked as one bundle but not separated per transaction, a state in which banknotes are stacked per transaction but the banknotes of a plurality of transactions are stacked together without being separated per transaction, and the like. That is, the mixed state of the banknotes is a state in which the banknotes per transaction cannot be distinguished.

FIG. 4 indicates an example of the banknote information managed in the first terminal 20. As shown in FIG. 4, the banknote information includes a shop number for identifying the shop 1 in which the first banknote handling apparatus 10 is installed, a transaction number allocated for distinguishing each of the transactions, in which the money deposit process of each of the banknote bundles 201~203 performed by each of the first to third register operators is being considered as one transaction, and a denomination and a serial number of the banknotes contained in each of the banknote bundles 201~203 processed in each of the transactions. FIG. 4 shows a specific example in which Chinese banknotes are processed. In FIG. 4, "100" in the denomination item means a banknote of CNY 100 and "50" means a banknote of CNY 50.

In the example of FIG. 4, the shop number for identifying the shop 1 is "A001". The transaction number is prepared so that the cashier who performed the transaction (deposit process) can be identified. In the example of FIG. 4, the transaction number is prepared by combining a number indicating a date and each of the IDs, i.e., "C01" to "C03", for recognizing each of the first to third cashiers who performed the deposit processes. From this banknote information, it can be understood that the banknotes that were deposited by the first cashier whose ID is "C01" include a CNY 100 banknote having a serial number "AB . . . ", and a CNY 50 banknote having a serial number "XY . . . ", and the like. Moreover, it can be understood that the banknotes that were deposited by the second cashier whose ID is "C02" include a CNY 100 banknote having a serial number "CD . . . ", and the banknotes that were deposited by the third cashier whose ID is "C03" include a CNY 100 banknote having a serial number "EF . . . ".

In this manner, from the banknote information, it is possible to recognize the denominations and the serial numbers, and calculate the total amount and the total number of all the banknotes processed in the deposit process in the shop 1 by each cashier. Moreover, by referring to the banknote information based on a serial number of a banknote, the shop in which this banknote was deposited, the business day on which this banknote was processed, and the cashier who handled this banknote can be identified.

When all the banknotes 201~203 are put in the banknote container 210 and the preparation for the transport thereof to the cash collection center 2 is completed, the two-dimensional barcode 220 including the banknote information of all the banknotes 201~203 in the banknote container 210 is generated by operating the operation/display unit 21 of the first terminal 20. The generated barcode is printed by the barcode printer 30 (A4 of FIG. 1). Specifically, the two-dimensional barcode 220 including the banknote information shown in FIG. 4 is generated. That is, such a two-dimensional barcode 220 is generated so that the shop number, the transaction numbers, and the denominations and the serial numbers included in each of the transaction numbers shown in FIG. 4 can be acquired by reading the two-dimensional barcode 220.

At a predetermined timing, such as after the business hours of the shop 1, the banknote container 210 filled with the banknotes 201~203 to be transported from the shop 1 to the cash collection center 2 and the two-dimensional barcode 220 are prepared and, the banknote container 210 to which the two-dimensional barcode 220 is attached is transported from the shop 1 to the cash collection center 2 (B1 of FIG. 1).

The method of attaching the two-dimensional barcode 220 to the banknote container 210 is not limited to a single method. For example, a piece of paper on which the two-dimensional barcode 220 has been printed can be stuck to the banknote container 210, or a piece of paper on which the two-dimensional barcode 220 has been printed can be put inside a case fastened to the banknote container 210. That is, any method can be used that allows information to be read immediately from the two-dimensional barcode 220 when handling the banknotes taken out of the banknote container 210 in the cash collection center 2.

Figure 5:
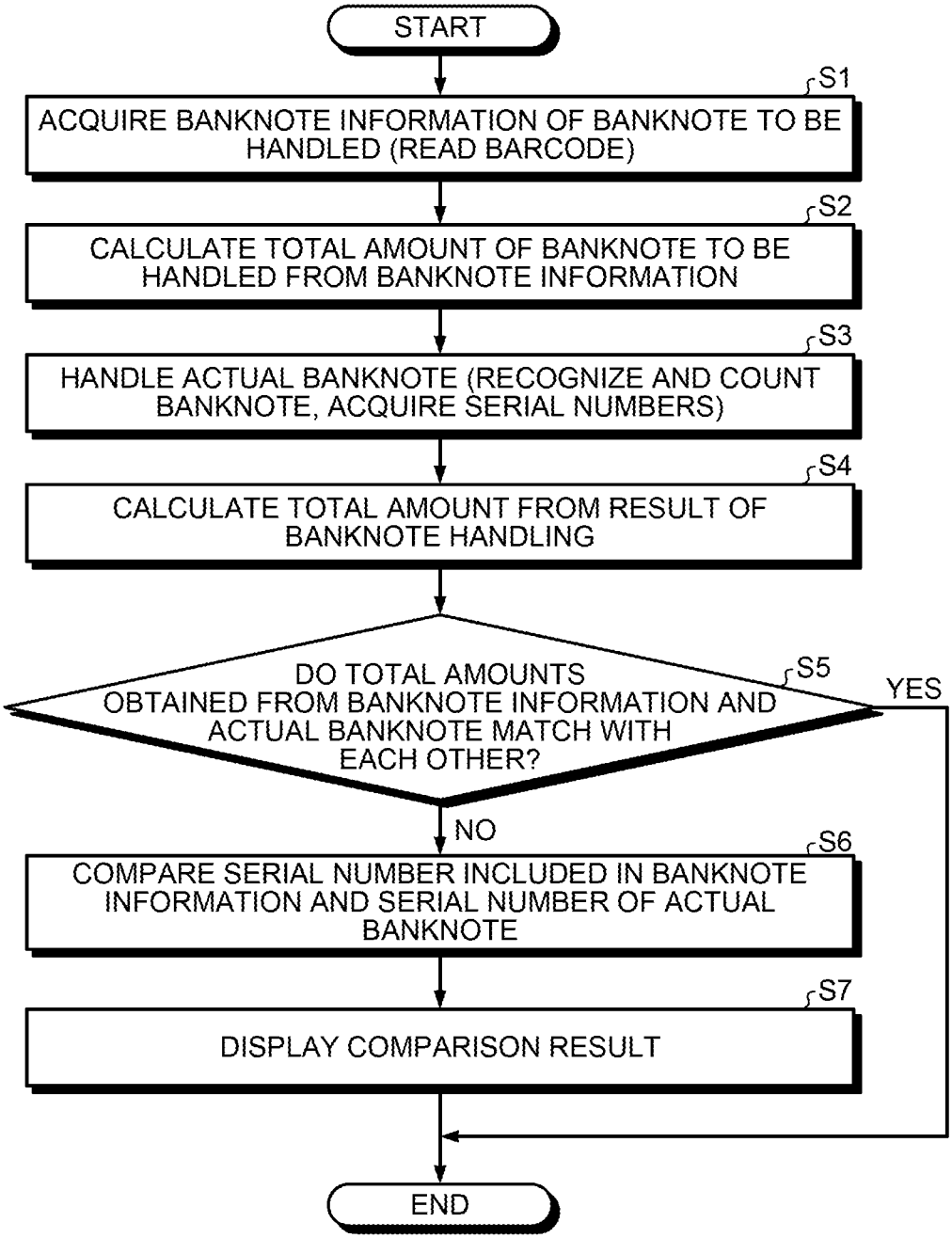
FIG. 5 is a flowchart of a banknote handling performed in the cash collection center.

The banknote handling performed in the cash collection center 2 is explained below with reference to FIGS. 1 and 5. FIG. 5 is a flowchart of the banknote handling performed in the cash collection center 2. When the banknote container 210 and the two-dimensional barcode 220 are brought to the cash collection center 2, the two-dimensional barcode 220 is read by using the barcode reader 130 connected to the second terminal 120 to acquire the banknote information (Step S1).

In the second terminal 120, the banknote information shown in FIG. 4 is decoded from the read two-dimensional barcode 220. The decoded banknote information is stored in the memory 123. When the banknote information including the denominations and the numbers of all the banknotes put in the banknote container 210 is obtained, the control unit 122 of the second terminal 120 calculates a total amount of the banknotes 201~203 that were put in the banknote container 210 (Step S2).

In the second banknote handling apparatus 110, banknotes 204 in the banknote container 210 are processed (Step S3). All the banknotes 201~203 collected in the shop 1 are put in the banknote container 210 in the mixed state, and the banknotes collected from each of the cash-registers cannot be distinguished. When the banknotes were brought to the cash collection center 2, it is not yet checked whether all the banknotes 201~203 were actually put in the banknote container 210. There is a possibility that the banknotes 201~203 deposited actually are different from the banknotes 204 which are said to have been processed by the first banknote handling apparatus 10. Specifically, for example, there is a possibility that, before transporting or during transporting, some banknotes may be removed from the banknotes 201~203 or some unrelated banknotes may be inserted to the banknotes 201~203.

In the second banknote handling apparatus 110, it is determined whether the banknotes 204, which include banknotes of a plurality of transactions that are said to have been processed in the first banknote handling apparatus 10, match with the banknotes 201~203 of a plurality of transactions that were actually processed in the first banknote handling apparatus 10. To achieve this, the second banknote handling apparatus 110 recognizes and counts all the banknotes 204 taken out of the banknote container 210, and acquires the serial number of each of the banknotes 204. When the banknotes 204 are processed by the second banknote handling apparatus 110, a plurality of banknotes are placed on the hopper in a mixed state, and therefore the banknotes 201~203 per cash-register installed in the shop 1 cannot be distinguished. That is, the banknotes 201~203 per transaction cannot be distinguished. The banknotes on the hopper are fed one by one from the hopper to inside of the apparatus. The banknotes 204 are recognized and counted without separating per transaction, and are stacked in stackers according to the denomination thereof. The stacked banknotes are sorted by the denomination. In this manner, from the banknotes 204 put in the banknote container 210 in the mixed state, banknotes 205 that are separated according to the denomination thereof can be obtained as shown in FIG. 1.

The information such as the result of recognition and counting and the serial numbers of the banknotes obtained in the second banknote handling apparatus 110 is input into the second terminal 120, and the information is stored in the memory 123. When the banknote handling in the second banknote handling apparatus 110 is finished, the control unit 122 of the second terminal 120 calculates a total amount of all the banknotes 204 that were put in the banknote container 210 (Step S4). When the total amount is included in the result of recognition and counting input from the second banknote handling apparatus 110, this total amount is used and the calculation of the total amount is omitted.

The control unit 122 compares the total amount of the banknotes 201~203 calculated from the banknote information that is obtained by reading the two-dimensional barcode 220 and the total amount obtained by recognizing and counting the banknotes 204, which are said to have been deposited in the first banknote handling apparatus 10, taken out of the banknote container 210 (Step S5). That is, the total amount of all the banknotes 201~203 processed in the deposit process in the first banknote handling apparatus 10 of the shop 1 is compared with the total amount of the banknotes 204 transported to the cash collection center 2 by using the banknote container 210 and processed in the second banknote handling apparatus 110. It is checked whether both the amounts match with each other.

When both the total amounts match with each other (Step S5, Yes), the control unit 122 of the second terminal 120 determines that all the banknotes 201~203 deposited by using the first banknote handling apparatus 10 installed in the shop 1 were transported from the shop 1 to the cash collection center 2, and the process is finished.

However, even if the total amount of the banknotes 201~203 processed in the deposit process in the shop 1 and the total amount of the banknotes 204 processed in the cash collection center 2 match with each other, there is a possibility that the denominations and the numbers of the banknotes 201~203 actually processed in the first banknote handling apparatus 10 installed in the shop 1 and the denominations and the numbers of the banknotes 204 processed in the second banknote handling apparatus 110 installed in the cash collection center 2 do not match with each other. Even in such a situation, the second terminal 120 deems that the banknotes 204 of the plurality of transactions said to have been processed in the first banknote handling apparatus 10 match with the banknotes 201~203 of the plurality of transactions actually processed in the first banknote handling apparatus 10. Accordingly, even if some of the banknotes 201 processed in the first banknote handling apparatus 10 are replaced with banknotes of different denominations and numbers in money exchange and the like in the shop 1, a determination can be performed in the cash collection center 2 based only on the total amount, and it can be determined that there is no issue during the transport of the banknotes from the shop 1 to the cash collection center 2.

The method of checking whether the banknotes 201~203 processed in the shop 1 match with the banknotes 204 transported to the cash collection center 2 can be set as desired. As one method, for example, it can be set to check whether the total number of the banknotes 201~203 processed in the shop 1 and the total number of the banknotes 204 transported to the cash collection center 2 match with each other. In this setting, if both the numbers match with each other, it is deemed that all the banknotes are transported from the shop 1 to the cash collection center 2 without confirming whether the total amounts match with each other. In a further example, it can be set to check whether the serial numbers of the banknotes 201~203 processed in the shop 1 and the serial numbers of the banknotes 204 transported to the cash collection center 2 match with each other. In this setting, only when all the serial numbers match with each other, it is deemed that all the banknotes are transported from the shop 1 to the cash collection center 2.

A comparison process is performed between the total amount of the banknotes 201~203 calculated from the banknote information and the total amount obtained by recognizing and counting the banknotes 204 that were taken out of the banknote container 210. If both the amounts do not match with each other (Step S5, No), the control unit 122 of the second terminal 120 thereafter performs a comparison between the serial numbers of the banknotes 201~203 obtained from the banknote information after reading the two-dimensional barcode 220 thereof and the serial numbers of the banknotes 204 that were taken out of the banknote container 210 (Step S6). That is, it is checked whether the serial numbers of all the banknotes 201~203 processed in the deposit process in the first banknote handling apparatus 10 installed in the shop 1 and the serial numbers of all the banknotes 204 that were taken out of the banknote container 210 and processed in the second banknote handling apparatus 110 match with each other. When the result of the comparison of the serial numbers is obtained, the control unit 122 displays the result of the comparison on the operation/display unit 121 of the second terminal 120 (Step S7), and the process is finished.

The second terminal 120 compares the serial numbers of the banknotes 201~203 that were included in the banknote information and the serial numbers of the banknotes 204 acquired by the second banknote handling apparatus 110. If there is a difference between compared serial numbers, the second terminal 120 performs a process to notify this fact.

For example, if a banknote having a serial number that was recorded when the banknote was processed in the deposit process in the shop 1 is not included in the banknotes 204 processed in the cash collection center 2, the control unit 122 of the second terminal 120 performs a notifying process in which the serial number of this missing banknote is displayed on the operation/display unit 121. Moreover, based on the serial number of this missing banknote, the control unit 122 refers to the banknote information shown in FIG. 4 stored in the memory 123, and displays the shop number, the transaction number, and the denomination of the missing banknote on the operation/display unit 121. As a result, because the shop 1 and the cashier who handled the missing banknote can be identified based on the shop number and the ID information of the cashier included in the transaction number, the processing status of the missing banknote and the subsequent processes can be investigated and confirmed.

Alternatively, if a banknote having a serial number other than the serial numbers that were recorded when the banknotes were processed in the deposit process in the shop 1 is included in the banknotes 204 processed in the cash collection center 2, the control unit 122 determines that this banknote is a mixed banknote that got mixed after the deposit process was performed in the shop 1. The control unit 122 performs a notifying process in which the serial number and the denomination of the mixed banknote are displayed on the operation/display unit 121.

For example, if the money exchange is performed without permission by using the banknotes that were processed in the deposit process in the shop 1, banknotes used in the money exchange and lost banknotes can be estimated by comparing the missing banknotes and the mixed banknotes. This will be explained specifically in an example using Japanese banknotes. In this example, in the cash collection center 2 there are two missing banknotes, of one JPY 10000 banknote and one JPY 5000 banknote, and there are 10 mixed banknotes of JPY 1000. In this situation, it can be supposed that money exchange was performed to change one JPY 10000 banknote for 10 JPY 1000 banknotes. Also, it can be supposed that one JPY 5000 banknote has been lost. Accordingly, in consideration of the money exchange and the loss of the JPY 5000 banknote, the particulars of the banknote handling can be investigated. Similarly, for example, if there are 11 missing banknotes of 10 JPY 1000 banknotes and one JPY 5000 banknote, and one mixed banknote of JPY 10000 banknote. In this situation, it can be supposed that the money exchange was performed to change 10 JPY 1000 banknotes for one JPY 10000 banknote, and in consideration of the money exchange and the loss of the JPY 5000 banknote, a tracking investigation of the banknotes can be performed. At Step S5, even if the total amount of the banknotes 201~203 calculated from the banknote information and the total amount obtained by performing the recognizing and counting the banknotes in the second banknote handling apparatus 110 match with each other, such comparison process of the serial numbers can be performed to ensure whether the money exchange was performed.

In the second banknote handling apparatus 110, when performing a process to recognize the banknotes 204 taken out of the banknote container 210 and store recognized banknotes in the plurality of stackers separately according to their denomination, it is possible to automatically set the correspondence relation between the denominations and the stackers based on the banknote information acquired from the two-dimensional barcode 220. The banknote information includes information to identify the denominations, the number of banknotes per denomination, the total number, and the like of the banknotes 204 targeted for handling. By using this information, the control unit 114 of the second banknote handling apparatus 110 automatically performs denomination assignment to the stackers. For example, if the number of banknotes is small, the denomination of these banknotes is assigned to one stacker, and if the number of the banknotes is large, the denomination of these banknotes is assigned to two stackers. For example, in the second banknote handling apparatus 110, if a batch process is performed in which stacking of the subsequent banknotes is halted each time the banknotes of a predetermined number are stacked and the stacking of the banknotes is restarted after the stacked banknotes of the predetermined number are removed, a setting can be performed so that the banknotes of the denomination having a large number, whereby the number of times of removal thereof is large, are stacked in a stacker from which it is easy for an operator of the second banknote handling apparatus 110 to remove the stacked banknotes. Specifically, in the batch process, a setting can be performed so that the banknotes having a large number are stacked in a stacker that is nearer to an operator who operates the operation/display unit 121 and places the banknotes in the hopper, and the banknotes having small numbers are stacked in stackers that are away from the operator. Moreover, it can be set such that the control unit 122 of the second terminal 120 generates a plurality of patterns of the denomination assignments to the stackers and displays these patterns on the operation/display unit 121, and causes the operator to select the desired pattern. For example, if there are a plurality of stackers, based on the denominations and the numbers of the banknotes to be handled, a transport distance of the banknotes from the hopper to each of the stackers, a transport speed, and the like, the control unit 114 estimates a processing time necessary for the handling to separately stacking all the banknotes put on the hopper in the stackers for each of the patterns. The control unit 122 displays on the operation/display unit 121 the patterns and the estimated processing time for each of the patterns and causes the operator to select a pattern. After confirming and considering the information displayed on the operation/display unit 121, the operator can select, for example, a denomination assignment pattern to which he is accustomed to using, or can select a different denomination assignment pattern by taking into account the possibility of shortening of the processing time.

In the second banknote handling apparatus 110, when performing a process to recognize the banknotes 204 taken out of the banknote container 210 and store them in the different stackers separately according to the denomination, it is possible to set such that a recognition precision of the banknotes is automatically changed based on the banknote information acquired from the two-dimensional barcode 220. Specifically, a setting is made so that information about a recognition performance of the first banknote handling apparatus 10, information about recognition results of the banknotes, and the like are included in the banknote information, and by using the information acquired from the banknote information, the recognition precision of the second banknote handling apparatus 110 is automatically set in the second banknote handling apparatus 110. For example, if the first banknote handling apparatus 10 has the same recognition ability as that of the second banknote handling apparatus 110, because a banknote that was already recognized in the first banknote handling apparatus 10 is recognized again in the second banknote handling apparatus 110, the setting is automatically changed to reduce the recognition precision in the second banknote handling apparatus 110. That is, the standards for the recognition determination are set low. Moreover, for example, when handling a banknote in the second banknote handling apparatus 110 that was recognized as a genuine banknote in the first banknote handling apparatus 10, it is possible to set so that authentication is omitted. When doing so, for example, it is possible to set a condition so as not to reduce the recognition precision when a denomination and a serial number of a banknote were input manually as this banknote could not be recognized by the recognition unit 12 of the first banknote handling apparatus 10. Moreover, for example, when a stain such as a scribble is detected on a banknote in the first banknote handling apparatus 10, the setting can be automatically changed to increase the recognition precision in the second banknote handling apparatus 110 to allow detection of the stain with a high precision. That is, the standards for the recognition determination are set high. The changing of the setting of the recognition precision is not limited to be performed per processing but can be performed per banknote. For example, a banknote whose information was input manually or on which a stain was detected in the first banknote handling apparatus 10 is identified based on its serial number read by the second banknote handling apparatus 110, and the recognition precision of only such a banknote is increased as compared to the other banknotes. Moreover, for example, only when the serial number of the banknote acquired in the second banknote handling apparatus 110 is not included in the serial numbers acquired in the first banknote handling apparatus 10, the setting is automatically changed to increase the recognition precision of the authenticity and the like, so that the recognition determination is performed with stricter standards than the standards for banknotes that have been already recognized in the first banknote handling apparatus 10. Similarly, the setting can be automatically changed to reduce the recognition precision for a banknote that satisfies a predetermined condition. The change of the setting of the recognition precision includes, not only change of determination standards such as a threshold values or a template data, but also change of a setting about a transport control of a banknote such as making a distance between consecutive banknotes longer, reducing the transport speed of the banknotes, and the like to increase the recognition precision of banknotes.

Figure 6A:
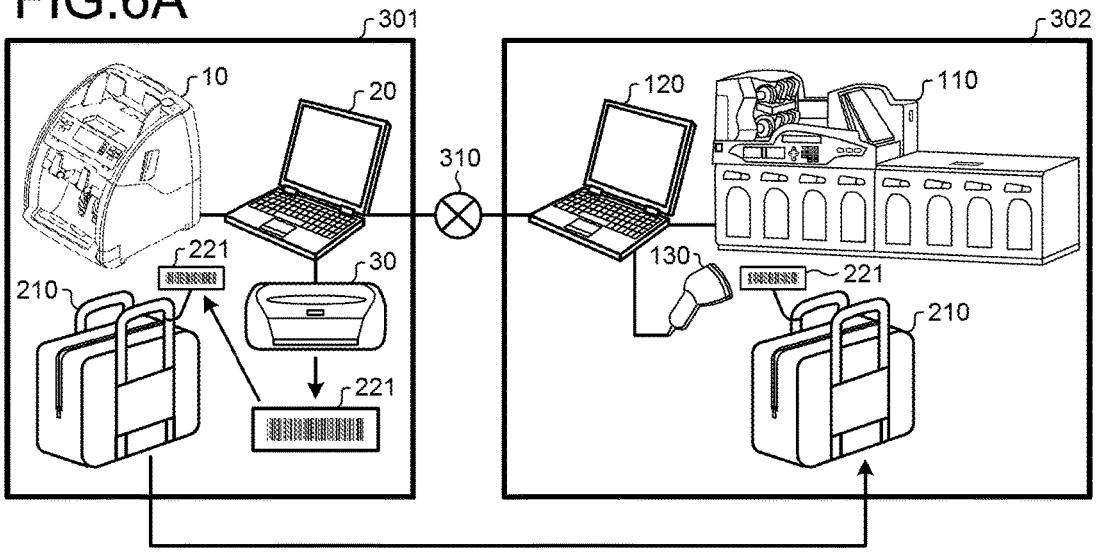
FIGS. 6A and 6B depict other embodiments of sending the banknote information from the shop to the cash collection center.
Figure 6B:
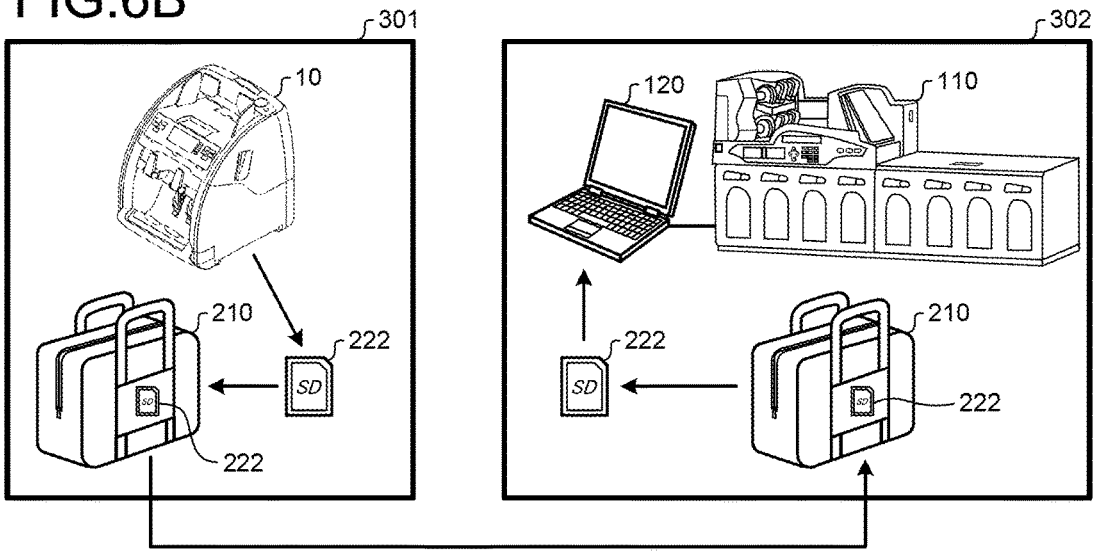

In the example shown in FIG. 1 in which the banknote information including the denominations and the serial numbers of all the banknotes 201~203 in the deposit process in the shop 1 is output as the two-dimensional barcode 220; however, the method of sending the banknote information from the shop 1 to the cash collection center 2 is not limited to this method. FIGS. 6A and 6B depict other embodiments of sending the banknote information from the shop 1 to the cash collection center 2.

FIG. 6A depicts an example in which the first terminal 20 of the first banknote handling system 301 installed in the shop 1 and the second terminal 120 of the second banknote handling system 302 installed in the cash collection center 2 are connected each other with a network 310, and the banknote information is transmitted as data via the network 310. In this case, when carrying the banknote container 210 out from the shop 1, a data number that is associated with the banknote information of the banknotes 201~203 put in the banknote container 210 is generated, and a barcode 221 indicating this data number is printed by the barcode printer 30. The first terminal 20 transmits the banknote information of the banknotes 201~203 put in the banknote container 210, in a state in which the data number is associated thereto, to the second terminal 120. The barcode 221 attached to the banknote container 210 is read by the barcode reader 130 in the cash collection center 2, and the banknote information associated with this data number is identified. Accordingly, the banknote handling can be performed in the second banknote handling system 302 as explained above.

FIG. 6B shows an example in which the first banknote handling apparatus 10 installed in the shop 1 has a function to write the banknote information in a portable storage medium 222. For example, in the first banknote handling apparatus 10, the banknote information is written in the portable storage medium 222, such as a USB memory or a memory card, and this portable storage medium 222 is attached to the banknote container 210. The banknote container 210 is then transported from the shop 1 to the cash collection center 2. In the cash collection center 2, the second terminal 120 reads the data from the portable storage medium 222 attached to the banknote container 210 thereby acquiring the banknote information of the banknotes 201~203 in the banknote container 210. With this information, the banknote handling can be performed in the second banknote handling system 302 as explained above.

In the system configurations shown in FIGS. 2, 3, and 6, functions of a plurality of apparatuses can be combined in a single apparatus. For example, the first banknote handling apparatus 10 can have the functions of one or both of the first terminal 20 and the barcode printer 30. Similarly, the second banknote handling apparatus 110 can have the functions of one or both of the second terminal 120 and the barcode reader 130.

Moreover, in the present embodiment, banknotes have been considered as the handling targets in the various handling; however, those handling can be similarly performed for coins. Like a banknote is distinguished by using a serial number, if a coin can be distinguished by using a money number, for example, by carving on the coin the money number (identification number) for distinguishing each coin, or embedding in the coin an information storing member such as an IC chip that stores therein the money number, the same effect can be obtained by performing the above-explained handling by using the money number read from the coin. That is, the first banknote handling system 301 including the first banknote handling apparatus 10 and the second banknote handling system 302 including the second banknote handling apparatus 110 can be replaced with a first money handling system 301 including a first money handling apparatus 10 and a second money handling system 302 including a second money handling apparatus 110, respectively. That is, banknotes as the target of handling can be replaced with coins or both the banknotes and coins can be taken as the target of handling.

Moreover, in the present embodiment, an explanation is given of a situation in which the banknotes contained in the banknote bundles 201~203 processed in the deposit process in the shop 1 were transported to the cash collection center 2 in the mixed state; however, the technique according to the present embodiment can be used even if the banknotes contained in the banknote bundles 201~203 processed in the deposit process in the shop 1 are transported to the cash collection center 2 in a state in which they are separated per transaction. Specifically, after transporting the banknotes in a state in which they are separated per transaction, the second banknote handling apparatus 110 in the cash center 2 recognizes and counts these banknotes of the plurality of transactions without distinguishing these banknotes per transaction. Based on the banknote information generated by performing the deposit process in the first banknote handling apparatus 10 installed in the shop 1 and the result of recognition and counting obtained in the second banknote handling apparatus 110, various processes such as the comparison process and the tracking investigation process can be performed as explained above. Even with such a configuration, when performing the banknote handling in the cash collection center 2, complicated work such as, for example, separating the banknotes per transaction by using the header cards and separately counting the banknotes becomes needless.

As explained above, according to the present embodiment, the banknote information including the denominations and the serial numbers of all the banknotes 201~203 handled in the shop 1 can be generated by using the first banknote handling system 301. When transporting the banknotes from the shop 1 to the cash collection center 2, the banknote information can be sent to the cash collection center 2 in various forms such as data included in the barcode, data on the network, data stored in the portable storage medium.

In the cash collection center 2, by using the second banknote handling system 302, the banknotes 204 that have been transported from the shop 1 to the cash collection center 2 are recognized and counted, and the total amount thereof is calculated. Moreover, by comparing this total amount with the total amount of the banknotes 201~203 calculated from the banknote information, it can be confirmed whether the total amount of the banknotes 204, which were transported from the shop 1 to the cash collection center 2, equals to the total amount of the banknotes 201~203 processed in the deposit process in the shop 1. If both the total amounts do not match with each other, a missing banknote that was lost after the deposit process, or a mixed banknote that got mixed after the deposit process can be identified based on the serial numbers of the banknotes. Moreover, because the information about the transaction in which the missing banknote was deposited, the denomination and the serial number of the mixed banknote, and the like are notified, the particulars of the banknote handling can be investigated and confirmed based on the notified information.

Moreover, because these processes can be performed by using the serial numbers of the banknotes, it is not necessary to prepare the header cards, and the work can be progressed easily. Moreover, because each transaction performed in the shop 1 can be distinguished based on the serial numbers of the banknotes, unlike when the header cards are used, it is not necessary to separate the banknotes per transaction and manage along with the header cards, or to put the banknotes in the banknote container 210 so that the banknotes of one transaction do not mix with the banknotes of other transactions, and therefore the work can be progressed easily.

INDUSTRIAL APPLICABILITY

As explained above, the money handling system and the money handling method according to the present invention is a useful technology that allows easy handling of the money collected in an office of a financial institution, a shop of a commercial facility, and the like.

EXPLANATION OF REFERENCE NUMERALS

1 shop
2 cash collection center
10 first banknote handling apparatus (first money handling apparatus)
11, 21, 111, 121 operation/display unit
12, 112 recognition unit
13, 113 banknote handling unit (money handling unit)
14, 22, 114, 122 control unit
20 first terminal
23, 123 memory
30 barcode printer
110 second banknote handling apparatus (second money handling apparatus)
120 second terminal (determination unit)
130 barcode reader
222 portable storage medium
301 first banknote handling system (first money handling system)
302 second banknote handling system (second money handling system)

The invention claimed is:

1. A money handling system comprising:

a container that transports money from a plurality of transactions processed by a first money handling apparatus;

a second money handling apparatus that receives, recognizes and counts the money from the plurality of transactions transported in the container; and a determination unit that acquires money information generated when the money from the plurality of transactions is processed by the first money handling apparatus, and based on the money information and a recognition and counting result obtained by the second money handling apparatus, determines whether the money from the plurality of transactions recognized and counted by the second money handling apparatus matches with the money from the plurality of transactions processed by the first money handling apparatus, wherein the money information includes information about the money from the plurality of transactions in at least one transaction unit, processed by the first money handling apparatus, the plurality of transactions processed by the first money handling apparatus include at least a first transaction involving first transaction money and a second transaction involving second transaction money, and the first transaction money and the second transaction money are processed by the second money handling apparatus in a mixed state such that the first transaction money cannot be distinguished from the second transaction money.

2. The money handling system as claimed in claim 1, wherein the determination unit performs the determination by performing a total comparison process in which a total amount of the money from the plurality of transactions according to the money information is compared with a total amount of the money transported in the container according to the second money handling apparatus regardless of a matching between a total number of the money from the plurality of transactions obtained based on the money information and a total number of the money taken out from the container.

3. The money handling system as claimed in claim 2, wherein the money information includes identification numbers of the money of each transaction processed in the first money handling apparatus, the identification numbers being separated per transaction, the second money handling apparatus acquires identification numbers of the money transported in the container, and when a result of the total comparison process indicates that the total number of banknotes according to the money information and the total number of banknotes according to the second money handling apparatus do not match with each other, the determination unit performs an identification number comparison process in which the identification numbers acquired by the second money handling apparatus are compared with the identification numbers included in the money information.

4. The money handling system as claimed in claim 1, wherein the determination unit performs the determination by performing a total comparison process in which a total number of banknotes in the money from the plurality of transactions obtained based on the money information is compared with a total number of banknotes in the money transported in the container obtained by the second money handling apparatus regardless of a matching between a total amount of the money from the plurality of transactions according to the money information and a total amount of the money transported in the container according to the second money handling apparatus.

5. The money handling system as claimed in claim 1, wherein the money information includes identification numbers of the money of each transaction processed in the first money handling apparatus, the identification numbers being separated per transaction, the second money handling apparatus acquires identification numbers of the money transported in the container, and the determination unit performs the determination by performing an identification number comparison process in which the identification numbers acquired by the second money handling apparatus are compared with the identification numbers included in the money information.

6. The money handling system as claimed in claim 5, wherein the determination unit identifies an identification number that does not match between the identification numbers included in the money information and the identification numbers acquired by the second money handling apparatus, and identifies a transaction to which the money having the identified identification number belongs.

7. The money handling system as claimed in claim 5, wherein the determination unit identifies an identification number that does not match between the identification numbers included in the money information and the identification numbers acquired by the second money handling apparatus, and provides information about the money having the identified identification number.

8. The money handling system as claimed in claim 1, wherein the money information is included in a code printed on a paper transported with the container.

9. The money handling system as claimed in claim 1, wherein the money information is generated when the money from the plurality of transactions performed in one facility is processed by the first money handling apparatus, and the money information includes information indicating the facility in which the plurality of transactions were performed.

10. The money handling system as claimed in claim 1, wherein the container does not have a structure that prevents mixing of the money from the plurality of transactions stored in the container.

11. The money handling system as claimed in claim 1, wherein the first transaction money and the second transaction money are provided in the mixed state in the container.

12. The money handling system as claimed in claim 1, wherein the money information includes a shop number for identifying a shop in which the first money handling apparatus is installed, a transaction number for distinguishing each of the plurality of transactions, a denomination of the money from each of the plurality of transactions, a serial number of the money from each of the plurality of transactions, or a combination thereof.

13. The money handling system as claimed in claim 1, wherein the first money handling apparatus is located at a first installation site, the second money handling apparatus is located at a second installation site different from the first installation site, and the container is configured to transport the money from the plurality of transactions from the first installation site to the second installation site.

14. A money handling system comprising:

a container that transports money from a plurality of transactions processed by a first money handling apparatus;

a money handling unit that recognizes and counts the money transported in the container without distinguishing the money from each transaction; and a determination unit that acquires money information about the money from the plurality of transactions generated previously per transaction, and based on the money information and a recognition and counting result obtained by the money handling unit, determines whether the money from the plurality of transactions processed in the money handling unit and the money identified based on the money information match with each other, wherein the money information includes information about the money from the plurality of transactions in at least one transaction unit, processed by the money handling unit, the plurality of transactions processed by the first money handling apparatus include at least a first transaction involving first transaction money and a second transaction involving second transaction money, and the first transaction money and the second transaction money are processed by the money handling unit in a mixed state such that the first transaction money cannot be distinguished from the second transaction money.

15. The money handling system as claimed in claim 14, wherein the determination unit performs the determination by performing a total comparison process in which a total amount of the money from the plurality of transactions according to the money information is compared with a total amount of the money transported in the container according to the money handling unit.

16. The money handling system as claimed in claim 15, wherein the money information includes identification numbers of the money of each transaction to be processed in the money handling unit, the identification numbers being separated per transaction, the money handling unit acquires identification numbers of the money transported in the container, and only when a result of the total comparison process indicates that the total amount of money from the plurality of transactions according to the money information and the total amount of the money transported in the container according to the money handling unit do not match with each other, the determination unit performs an identification number comparison process in which the identification numbers acquired by the money handling unit are compared with the identification numbers included in the money information.

17. A money handling method implemented by a money handling system comprising:

transporting a money container that stores money from a plurality of transactions processed by a first money handling apparatus;

recognizing and counting by a second money handling apparatus the money transported by the money container;

acquiring money information generated when the money from the plurality of transactions is processed by the first money handling apparatus, the money information including information about the money from the plurality of transactions in at least one transaction unit, processed by the first money handling apparatus; and determining whether the money recognized and counted by the second money handling apparatus matches with the money from the plurality of transactions processed by the first money handling apparatus, based on the money information and a recognition and counting result of the second money handling apparatus, wherein the plurality of transactions processed by the first money handling apparatus include at least a first transaction involving first transaction money and a second transaction involving second transaction money, and the first transaction money and the second transaction money are processed by the second money handling apparatus in a mixed state such that the first transaction money cannot be distinguished from the second transaction money.

18. The money handling method as claimed in claim 17 further comprising:

recognizing and counting by the first money handling apparatus the money from the plurality of transactions per transaction;

generating the money information including the recognition and counting result obtained at the recognizing and counting by the first money handling apparatus, the recognition and counting result being separated per transaction;

putting money of each transaction processed at the recognizing and counting in the money container; and wherein in the transporting, the money container is transported from an installation site of the first money handling apparatus to an installation site of the second money handling apparatus.

* * * * *